United States Patent [19]

Mazzola et al.

[11] 4,361,942

[45] Dec. 7, 1982

[54] TERMINAL APPLYING MACHINE

[75] Inventors: Ralph Mazzola, Brighton; Harry V. Leaf, Marshfield, both of Mass.

[73] Assignee: Ark-Les Corporation, Watertown, Mass.

[21] Appl. No.: 190,046

[22] Filed: Sep. 23, 1980

[51] Int. Cl.[3] ..... H01R 43/04

[52] U.S. Cl. ..... 29/33 M; 29/564.4; 29/748; 29/759

[58] Field of Search ..... 29/33 M, 564.1, 564.4, 29/564.6, 748, 749, 759, 715, 564.2

[56] References Cited

U.S. PATENT DOCUMENTS 3,672,025 6/1972 Gudmestad ..... 29/715 X 3,909,900 10/1975 Gudmestad ..... 29/564.4

3,965,559 6/1976 Mazzola ..... 29/564.2

*Primary Examiner*—Z. R. Bilinsky

[57] ABSTRACT

A novel automatic wire terminal applying machine for attaching closed barrel terminals to the ends of lengths of wire is disclosed. In addition to the conventional operating mechanisms, including wire clamps, wire cutter and strippers, and terminal applicators, the wire end position control for longitudinally moving the wire clamps for retracting the stripped wire end to position it in overlapping relationship with the terminal for application of the terminal further includes wire insertion means for advancing the stripped wire end prior to operation of the terminal applicator for longitudinal, rather than transverse, insertion into the open end of a closed barrel terminal.

4 Claims, 23 Drawing Figures

12
13
14
15
19
116
117
144
146
147
148
149
151
152
153
154
155
156
158
160
162
164
166
168

TERMINAL APPLYING MACHINE

This invention relates to apparatus used for attaching terminals to one or both ends of a piece of wire. In particular, the present invention relates to modifications of such apparatus to permit the attachment of closed barrel terminals as well as other in-line and flag terminals to the wire.

The apparatus of the invention is a modification of a portion of an automatic terminal applying machine similar to that disclosed in Gudmestad, U.S. Pat. No. 3,672,025, issued June 27, 1972. The machine disclosed in that patent provides means to attach in-line open barrel terminals to each end of a measured length of wire. One aspect of the invention is a modification of a portion of an automatic terminal applying machine similar to that disclosed in Mazzola, U.S. Pat. No. 3,965,559, issued June 29, 1976. The machine disclosed in that patent provides a conventional wire guide tube.

Accordingly, it is a major object of the present invention to provide a modified terminal applying machine that can attach closed barrel terminals to a piece of wire.

It is another object of the present invention to provide such a modification in a terminal applying machine that can be easily disengaged so that the machine can easily be adapted to apply other in-line and flag terminals.

It is a further object of the present invention to provide novel wire guide tubes that can be used in either flag, in-line open barrel, or in-line closed barrel terminal applying machines.

The above and still further objects of the present invention are provided by a novel automatic wire terminal applying machine for attaching a closed barrel terminal to at least one end of a length of wire. Preferably, each closed barrel terminal has a metal body that includes a terminal portion and a wire-receiving closed barrel portion of generally cylindrical shape.

The wire terminal applying machine has a plurality of longitudinally arranged operating means which includes wire feed means for feeding a length of wire, guide tube means for guiding a length of wire, longitudinally movable wire clamping means, wire cutting means for cutting the wire, wire stripping means for stripping a wire end, terminal strip feed means for feeding a terminal, transversely movable terminal applicator means longitudinally spaced between the wire clamping and stripping means and operable to apply a terminal to a stripped wire end positioned in overlapping relationship with the terminal, and wire end position control means for longitudinally moving the wire clamping means to position the stripped wire end in overlapping relationship with the terminal for transverse application of the terminal thereto.

In the preferred embodiment, the wire end position control means includes wire retraction means, wire insertion means and reset means. The wire retraction means is provided for retracting the stripped wire end prior to operation of the terminal applicator means to a non-overlapping position longitudinally spaced from the terminal. The wire retraction means has trip means adapted to terminate the further retraction of the stripped wire end and to actuate the wire insertion means.

The wire insertion means is used for advancing the stripped wire end prior to operation of the terminal applicator means from its non-overlapping position to advance the stripped wire end for longitudinal insertion thereof into its overlapping terminal position. The wire insertion means has depth of insertion means adapted to terminate the advance of the stripped wire end in the wire-receiving portion of the terminal. The reset means is adapted to reset the wire end position control means.

Preferably, the terminal applying machine further includes wire end aligning and guiding means for longitudinally aligning the stripped wire end with a wire-receiving portion of a closed barrel terminal and for guiding the stripped wire end into the wire-receiving portion.

In the preferred embodiment, the guide tube means of the terminal applying machine includes an outer guide tube adapted to center and to guide the attached terminal through the machine. The outer guide tube has a spring-biased inner guide tube concentric with the outer tube adjacent a forward end of the outer tube and is adapted to receive the wire. The outer tube is adapted to receive the attached terminal within the forward end of the outer tube when guiding the attached terminal through the machine.

In alternative embodiments of the present invention, guide tube means having an outer guide tube and a spring-biased inner guide tube is adapted for use in the terminal applying machine disclosed in U.S. Pat. No. 3,672,025 or the improved machine for attaching flag terminals disclosed in U.S. Pat. No. 3,965,559.

For the purpose of more fully explaining the above and still further objects and features of the present invention, reference is now made to the following detailed description of a preferred embodiment thereof, taken together with the accompanying drawings, wherein.

Figure 4:
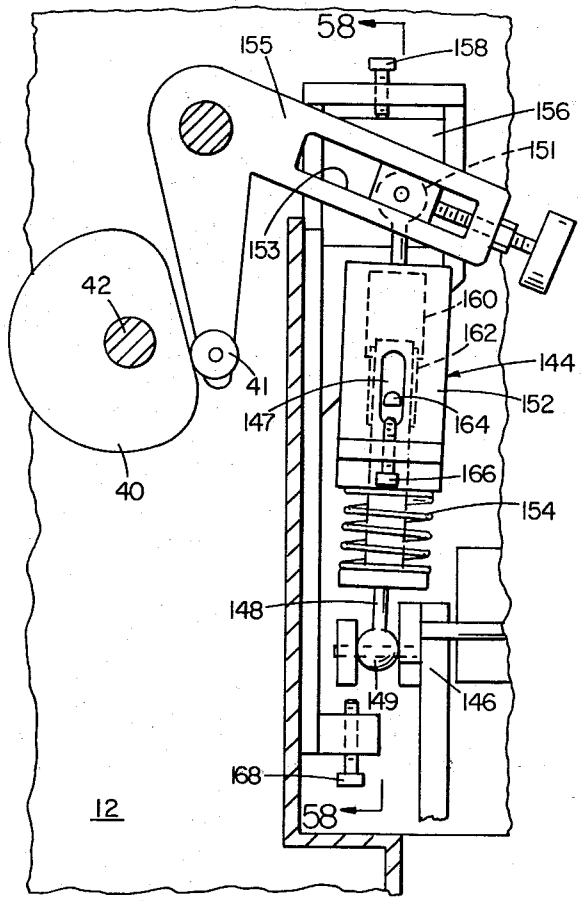
FIG. 4 is a vertical cross-sectional side view of the wire end position control means of FIG. 3, taken along line 4—4 thereof.
Figure 3:
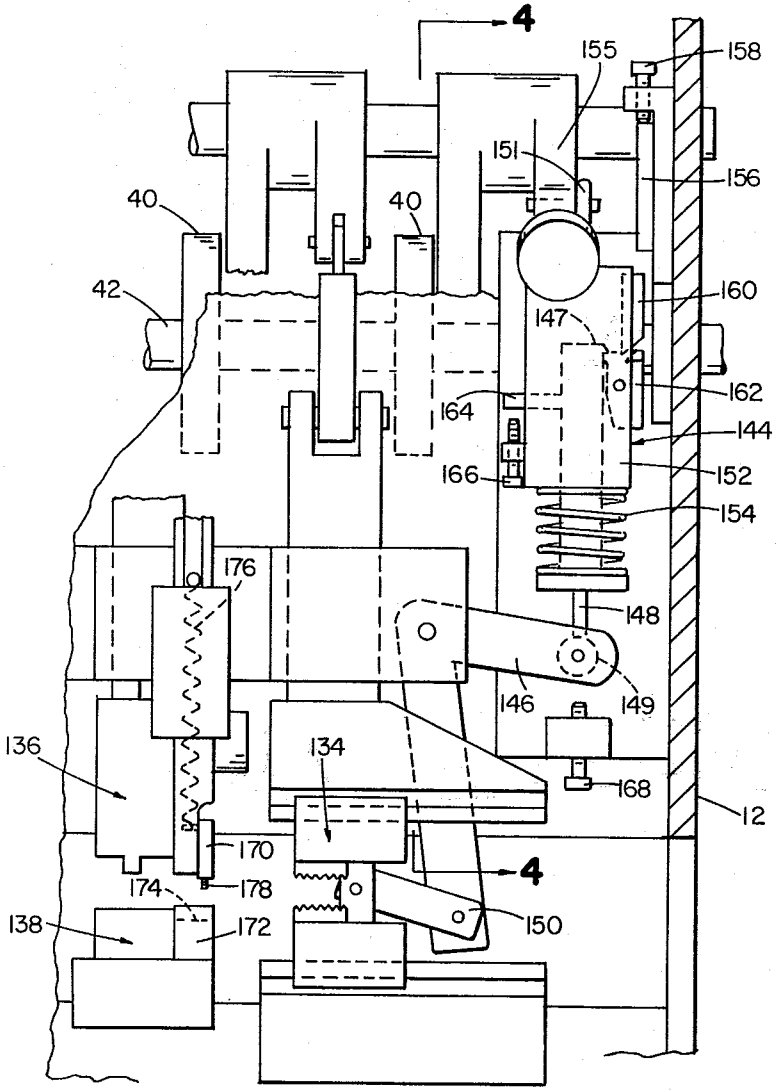
FIG. 3 is an enlarged front view of the wire end position control means of the terminal applying machine of FIGS. 1 and 2.

FIGS. 5*a* through 8*a* are diagrammatic cross-sectional views, partially broken away, of the wire end position control means of FIGS. 3 and 4, taken along line 58—58 of FIG. 4, illustrating its movement;

FIGS. 5*b* through 8*b* are diagrammatic views of the insertion of a stripped wire end into a closed barrel terminal, shown in side sectional view, corresponding to the movement shown in FIGS. 5*a* through 8*a;*

Figure 1:
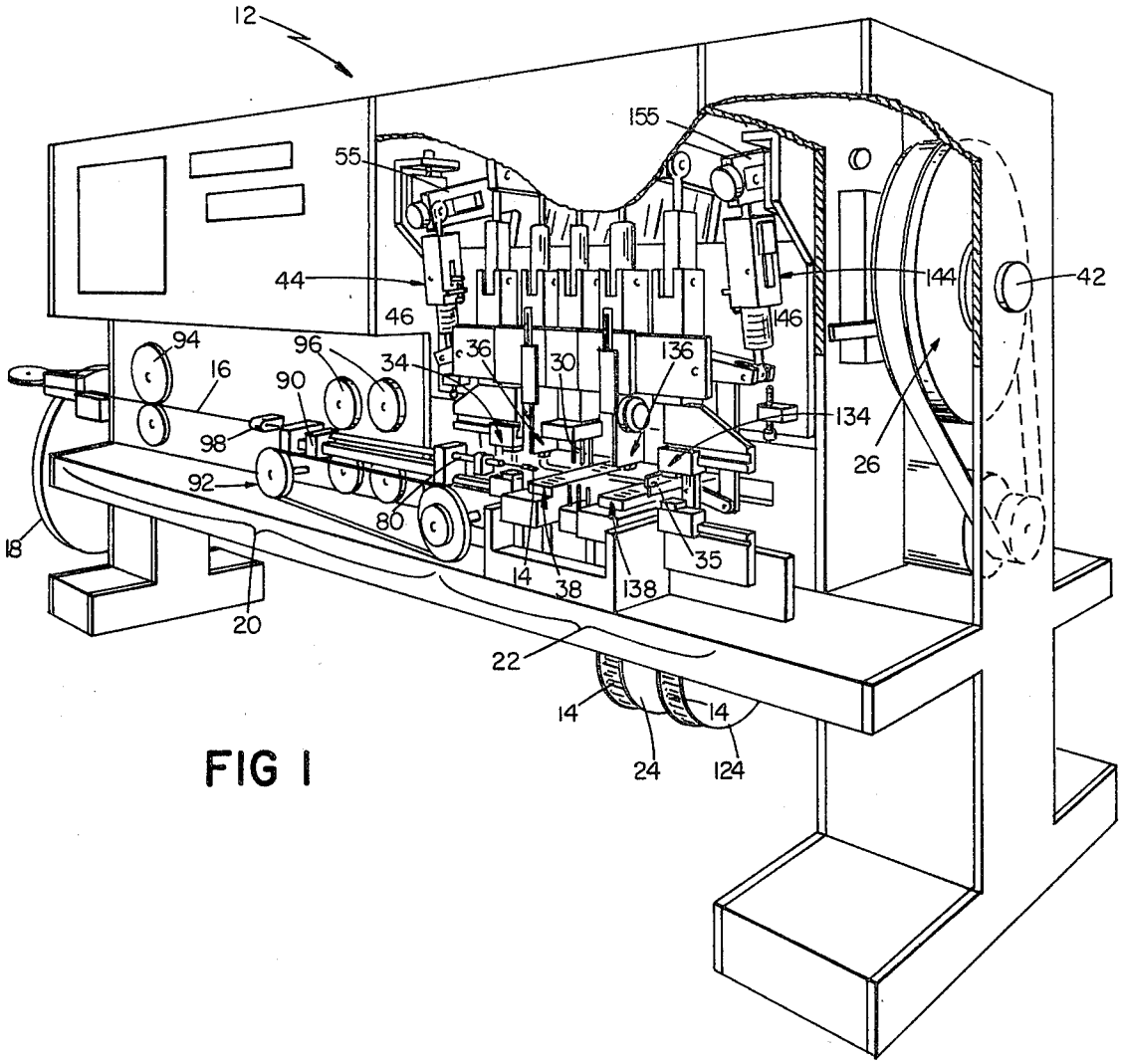
FIG. 1 is a perspective view of the automatic terminal applying machine of the present invention, partially broken away.
Figure 9:
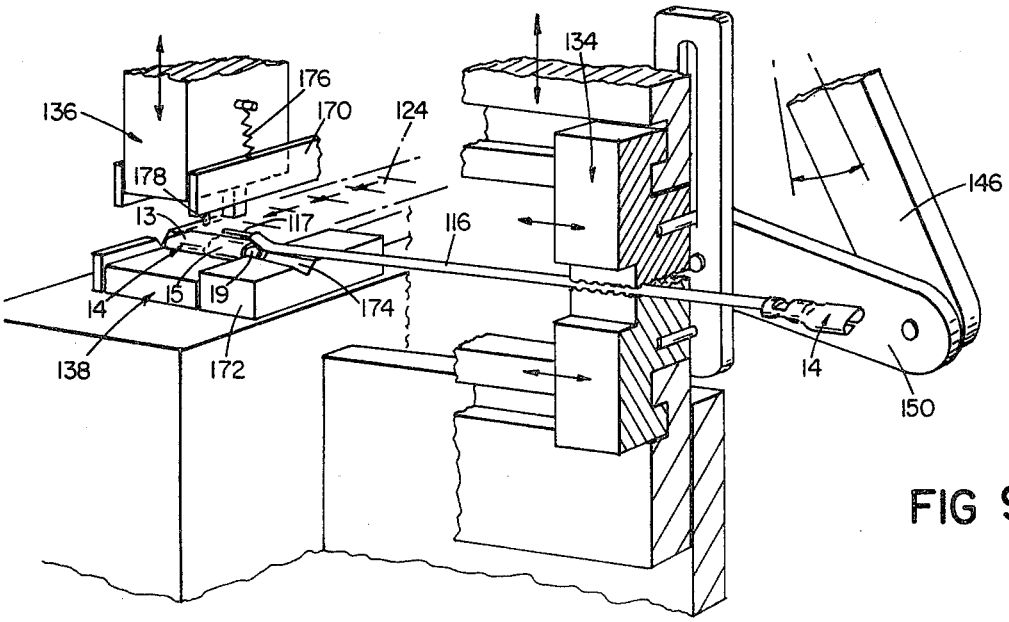
Figure 2:
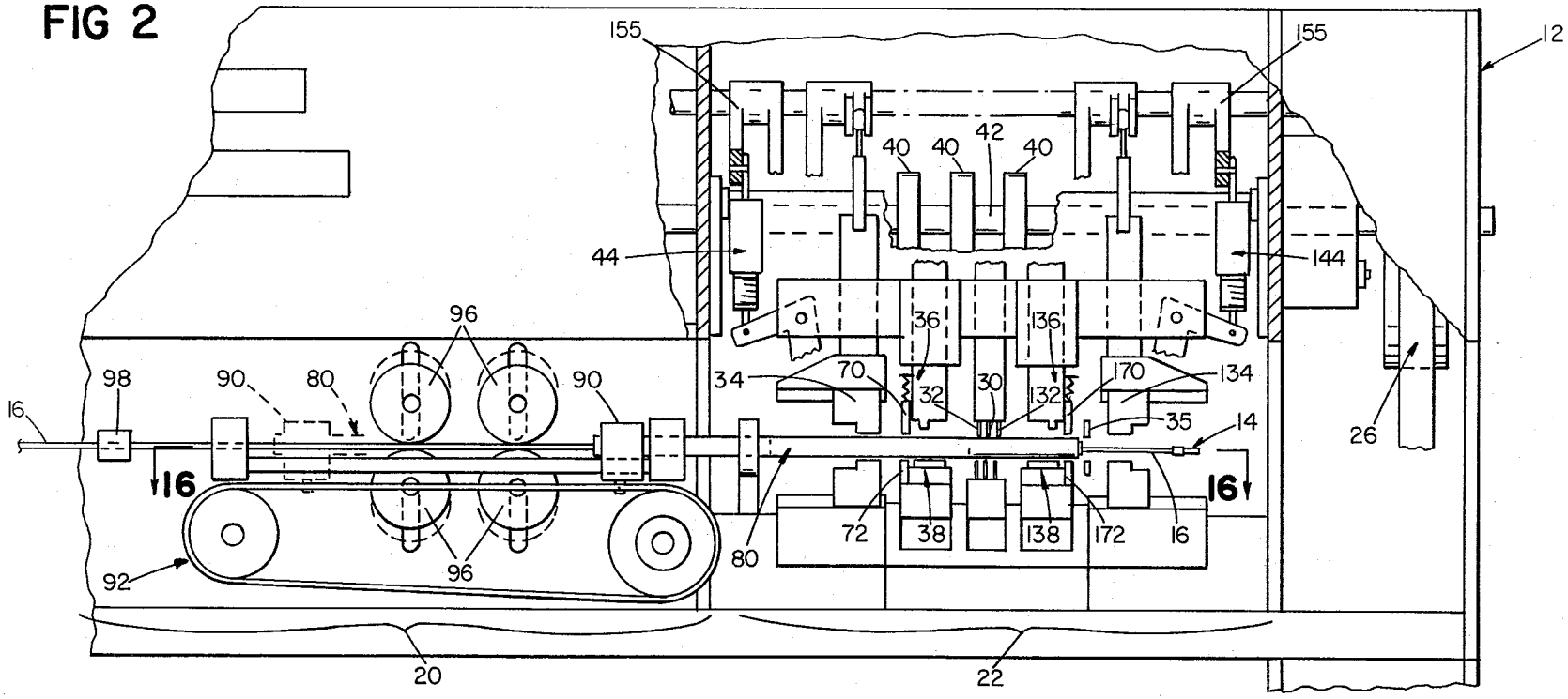
FIG. 2 is a detailed front view of the terminal applying machine of FIG. 1.
Figure 18:
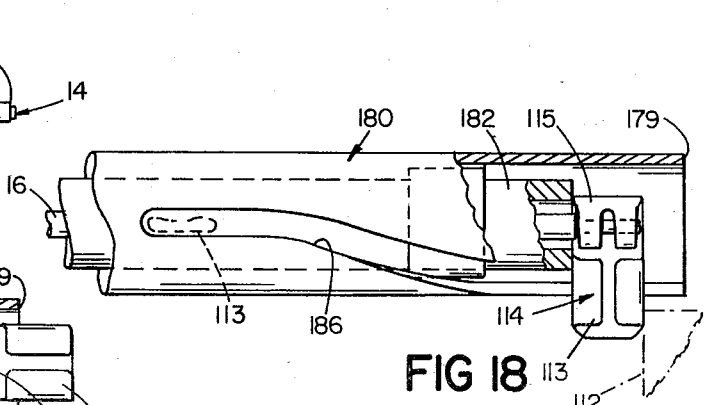
Figure 16:
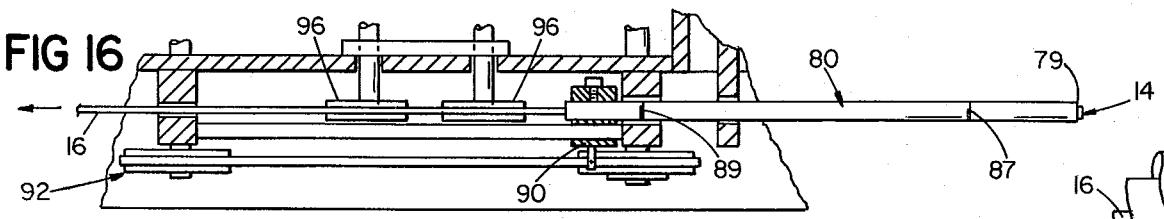
Figure 17:
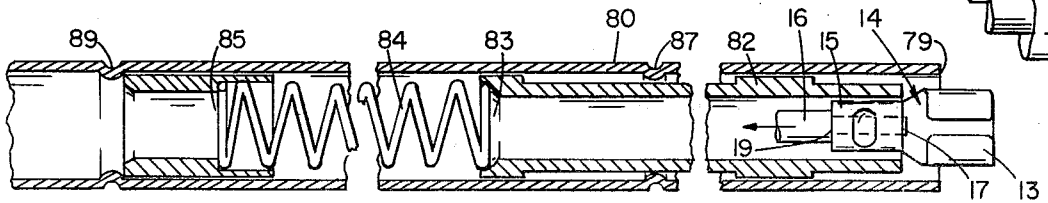
Figure 19:
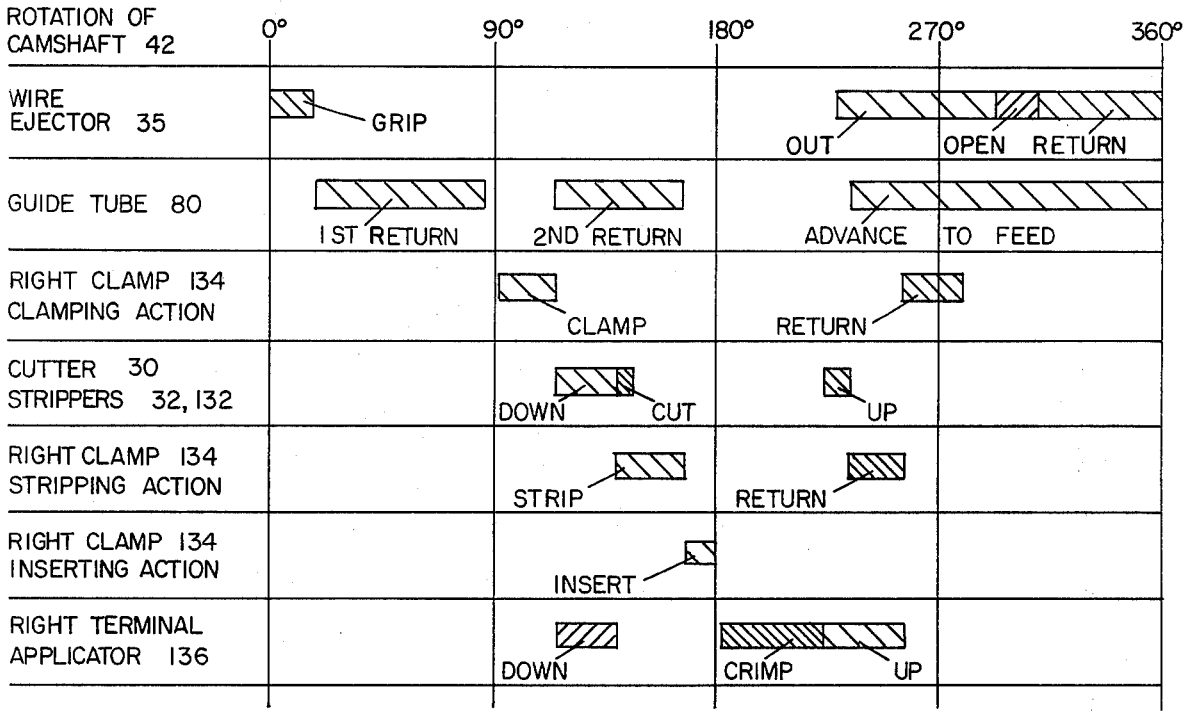

FIG. 9 is a diagrammatic perspective view, partially broken away, of the wire end aligning and guiding means, terminal applicator means and wire clamping means of FIGS. 1, 2 and 3;

FIGS. 10–15 are diagrammatic front views of the terminal applying machine of FIGS. 1 and 2, partially broken away, illustrating the sequence of operation in attaching a closed barrel terminal to a length of wire;

FIG. 16 is a cross-sectional top view, partially broken away, of the wire feed means and the guide tube means of FIGS. 1 and 2, taken along line 16—16 of FIG. 2;

FIG. 17 is an enlarged cross-sectional view, partially broken away, of the guide tube of FIGS. 1, 2 and 16;

FIG. 18 is an enlarged view, partially broken away, of a modified guide tube adapted to receive flag terminals; and FIG. 19 is a timing diagram of the operation of the terminal applying machine of the invention.

The apparatus of the invention is a modification of a portion of an automatic terminal applying machine similar to that disclosed in U.S. Pat. No. 3,672,025. The machine disclosed in that patent provides means to attach to each end of a measured length of wire, in-line open barrel terminals, that is, terminals having an open sided wire-receiving portion so that the wire can be inserted in a transverse direction. The modification of the present invention permits this or similar apparatus to attach to the ends of lengths of wire closed barrel terminals, that is, terminals in which the wire-receiving portion has closed sides so that the wire must be inserted in a longitudinal direction into the open end of the terminal.

The guide tube of the present invention is a modification of both the automatic terminal applying machine similar to that disclosed in said U.S. Pat. No. 3,672,025 and that disclosed in U.S. Pat. No. 3,965,559.

Referring to the drawings, and more particularly to FIG. 1, an automatic wire terminal applying machine, generally designated 12, is shown for attaching closed barrel terminals 14 to each end of a measured length of wire 116. Machine 12 is a modification of U.S. Pat. No. 3,672,025, which includes generally a spool 18 of wire 16, a wire metering and feed assembly 20, a terminal attaching assembly 22, spools 24, 124 of feed stock closed barrel terminals 14, and a motor and belt assembly 26 for driving terminal attaching assembly 22. Closed barrel terminal 14, as best shown in FIGS. 5*b* through 8*b* and 17, has a metal body that includes a terminal portion 13 and a wire-receiving closed barrel portion 15 of generally cylindrical shape with enclosed sides and an open end 19.

More particularly, as shown in greater detail in FIG. 2, terminal attaching assembly 22 includes wire cutter 30, wire end strippers 32 and 132, longitudinally movable wire clamps 34 and 134 on either side of cutter 30 and strippers 32 and 132, transversely movable terminal applicators 36 and 136 longitudinally spaced between wire clamps 34, 134 and strippers 32, 132 and operable to apply a terminal 14 to a stripped wire end 17 positioned in overlapping relationship with terminal 14, terminal strip feed assemblies 38 and 138 for feeding a terminal 14 to terminal applicators 36 and 136, respectively, and ejector 35 for removing free section of wire 116 having terminals 14 attached to both of its ends. These components are driven by cams 40 on cam shaft 42, which is itself driven by motor and belt assembly 26 in a conventional manner.

The present invention describes a modification of the operating mechanism of clamp 34. Either or both of clamps 34 and 134 may be modified according to the present invention to permit the application of closed barrel terminals 14. The modification of clamp 134 is similar, but the orientation of stripped wire end 17 and terminal 14 is in effect a mirror image of that of clamp 34.

In general terms, the machine of the invention operates like the machine of U.S. Pat. No. 3,672,025. During a 360 degree rotation of cam shaft 42, as best illustrated in the sequence of FIG. 10 through FIG. 15, wire guide tube 80 first advances to the right past terminal attaching assembly 22, whose cutters, applicators and clamps are all open. Insulated wire 16 is supplied at spool 18 and is fed through guide tube 80, with a terminal 14 from the previous cycle of operation attached to the leading end 17 of wire 16. The distance through which wire 16 is advanced through guide tube 80 is determined by the metering apparatus 94 of assembly 20. Feed means in applicators 36 and 136 advance a terminal 14 into crimping position in each applicator. Wire guide tube 80 is withdrawn and wire 16 is held by clamps 34 and 134. Cutter 30 is closed to sever insulated wire 16, defining a section of wire 116 which is clamped by clamp 134. Simultaneously with cutter 30, strippers 32 and 132 are closed to cut through the insulation of wire 16 at two points on either side of the point of severance to permit stripping. Clamps 34 and 134 retract the severed portions of wire 16 and section of wire 116, respectively, to provide the stripping action and to insert the stripped wire ends 17 and 117 into the terminals 14 positioned in terminal applicators 36 and 136, respectively. Applicators 36 and 136 are then operated to attach terminals 14 to the two cut and stripped wire ends 17 and 117, and the free section of wire 116 (to the right of stripper 132) including attached terminals 14 at both ends, is removed by ejector 35. Wire guide tube 80 then advances again and the cycle is repeated.

According to the present invention, the modification of machine 12 provides wire end position control assemblies, generally designated 44 and 144, as best shown in FIGS. 3, 4, 5*a*, 6*a*, 7*a* and 8*a*, for producing the additional longitudinal movement of wire clamps 34 and 134, respectively, necessary to position stripped wire ends 17, 117 in overlapping relationship within the closed barrel of terminals 14 for transverse application of terminals 14 thereto. To accomplish this, wire end position control assembly 44 includes a wire retraction mechanism, a wire insertion mechanism and a reset mechanism. Since wire end position control assembly 144 is a mirror image of assembly 44, only assembly 144 is described herein. The numerical designations for mechanisms in assembly 144 are provided by adding a numeral "1" before the numerals designating corresponding mechanisms in assembly 44.

Figures 5A, 5B, 6A, 6B, 7A, 7B, 8A, 8B:
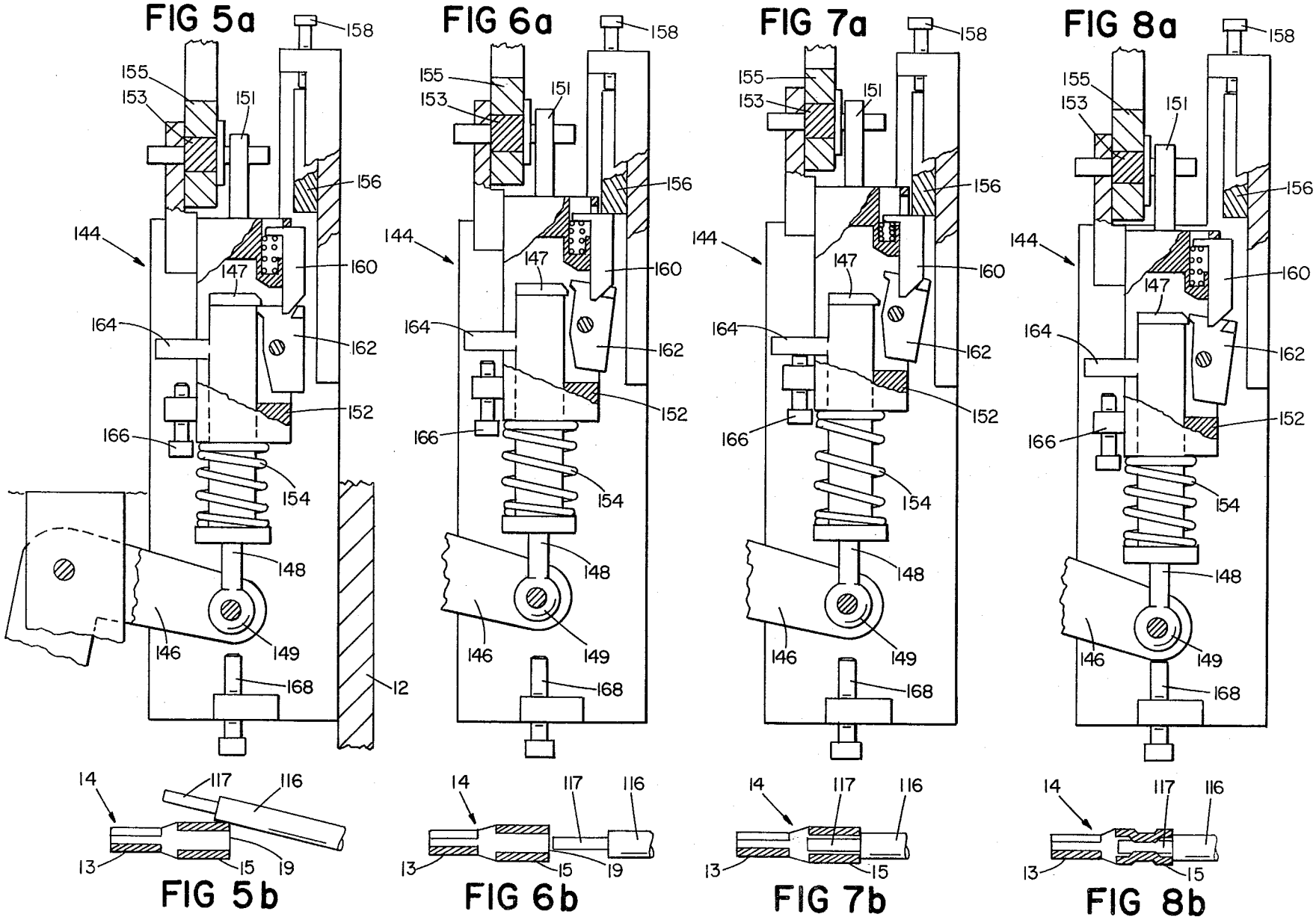

More particularly, as best shown in FIGS. 3 through 9, the wire retraction mechanism of the present invention is provided for further retracting a stripped wire end 117, prior to operation of terminal applicator 136, to a non-overlapping position longitudinally spaced beyond the open end 19 of terminal 14, as shown in FIG. 6*b*. The wire retraction mechanism includes a bell crank 146 connected to a piston rod 148 at one end and a link 150 at the other end, link 150 being connected to clamp 135. Bell crank 146 and link 150 are provided to drive piston rod 148 upwardly into piston body 152 as clamp 134 moves away from applicator 136. Upper portion 151 of piston body 152 is adjustably mounted within a slotted bracket 153 of cam lever 155, the cam follower 41 of which is in contact with the surface of a cam 40. When driven by cam 40, piston body 152 is adapted to move upwardly to pull clamp 134 to the right, as shown in FIG. 3, away from applicator 136. The upper end 147 of piston rod 148, positioned within piston body 152, is surrounded by coil compression spring 154. The wire retraction mechanism further includes release plate 156, which is adapted to terminate retraction of stripped wire end 117 and to actuate the wire insertion mechanism. Release plate 156 may be vertically adjusted by release plate screw 158 to control the distance of the retraction of clamp 134.

The wire insertion mechanism of the present invention is provided for advancing stripped wire end 117, prior to operation of terminal applicator 136, from its non-overlapping position, as shown in FIG. 6*b*, to advance stripped wire end 117 for longitudinal insertion thereof into the overlapping terminal position, as shown in FIG. 7*b*. The wire insertion mechanism has a depth of insertion mechanism for terminating the advance of stripped wire end 117 into the wire-receiving portion 15 of terminal 14. Wire insertion mechanism includes a piston rod trip member 160 which, upon contact with release plate 156, triggers the release of piston rod latch 162, which normally latches the upper end catch block 147 of piston rod 148. Due to this triggering action, compression spring 154 forces lower end 149 of piston rod 148 downward, thereby moving clamp 134 forward, to the left as shown in FIGS. 3 through 9, to insert stripped wire end 117 into the open end 19 of terminal 14. Piston rod 148 further includes a stop insertion block 164 which terminates the downward movement of piston rod 148 when block 164 contacts stop insertion screw 166. Screw 166 may be adjusted to control the depth of insertion of stripped wire end 117 in wire-receiving portion 15 of terminal 14.

Finally, the reset mechanism is provided to reset wire end position control mechanism 144. A reset screw 168, when in contact with the lower end 149 of piston rod 148, causes upper end catch block 147 of piston rod 148 to latch onto piston rod latch 162, thereby allowing the cycle to repeat.

The modification of machine 12 further includes an wire end aligning and guiding mechanism, as best shown in FIG. 9, for aligning stripped wire end 117 with wire-receiving portion 15 of closed barrel terminal 14 and for guiding stripped wire end 117 into its open end 19. The wire end aligning and guiding mechanism includes a downwardly extending hold down member 170 mounted on terminal applicator 136 and a cooperating base member 172 having a generally V-shaped notch 174. Member 170 is normally biased by an extension spring 176 and includes an adjustable screw 178 which is adapted to contact base member 172. Screw 178 may be adjusted to match the gauge of wire 16 in order to prevent wire 16 from being crushed by member 170. Member 170 is adapted to hold and align stripped wire end 117 with the open end 19 of terminal 14 as stripped wire end 117 is pulled by clamp 134 from the overlapping position atop terminal 14, as shown in FIG. 5*b*, to the non-overlapping position longitudinally spaced from the open end 19 of terminal 14, as shown in FIG. 6*b*. Notch 174 aligns and guides stripped wire end 117 into wire-receiving portion 15 of terminal 14, as shown in FIG. 7*b*.

In the preferred embodiment of the guide tube aspect of the present invention, wire guide tube 80 of terminal applying machine 12, as best shown in FIGS. 16 and 17, includes an inner guide tube 82 adapted to center and to guide an attached terminal 14 through machine 12. As best shown in FIGS. 1, 2 and 16, guide tube 80 is mounted on a longitudinally movable slide block 90 which is driven by guide tube motor and belt mechanism 92. Wire 16, metered by metering apparatus 94, may be fed forward through inner guide tube 82 by two pairs of transversely movable drive wheels 96. A wire feed brake 98 is used to prevent backward movement of wire 16, brake 98 being arranged to allow feeding of wire 16 when guide tube 80 is moving toward the right and to stop feeding of wire 16 at other times. Inner guide tube 82 is concentric with outer tube 80 and is mounted therein adjacent the forward end 79 of outer tube 80. The other end 83 of inner tube 82 engages compression spring 84. A cylindrical detent 87, which extends inwardly from the inner surface of outer guide tube 80, prevents forward movement of the other end 83 of inner guide tube 82. Similarly, an inwardly extending cylindrical detent 89 is used as a stop for end 85 of spring 84. During the forward movement of outer tube 80 at the beginning of each cycle, its forward end 79 retains attached terminal 14 enclosed within outer guide tube 80 in order to prevent terminal 14 from being caught on the various mechanisms as it is being guided through machine 12. Inner tube 82 receives wire 16 which is being fed from wire metering and feed assembly 20.

In an alternative embodiment of the guide tube of the present invention, wire guide tube 80 with its spring-biased inner tube 82 may be used in the terminal applying machine disclosed in U.S. Pat. No. 3,672,025. Tube 80, as disclosed in said U.S. Pat. No. 3,672,025 without an inner guide tube, tends to allow an attached terminal 14 to droop outside the forward end 79 of tube 80, thereby making it possible for its attached terminal 14 to be easily torn off by the mechanisms of machine 12 as tube 80 moves to the right.

In another alternative embodiment of the guide tube of the present invention, as best shown in FIG. 18, a wire guide tube 180 having a spring-biased inner tube 182 and a helical tension relieving cam slot 186 at the forward end 179 of tube 180 may be adapted for use in the improved machine for attaching flag terminals disclosed in U.S. Pat. No. 3,965,559. Slot 186 is adapted to rotate the attached flag terminal 114 in a direction 90 degrees from its original attached position upon contact with any of the various mechanisms of machine 12, as guide tube 180 moves toward the right. As best illustrated in FIG. 18, whenever the terminal portion 113 of an attached flag terminal 114 extending beyond the diameter of tube 180, contacts machine part 112 of machine 12, it is moved rearwardly away from the forward end 179 of tube 180 in order to relieve the tension of impact on portion 113 and also is rotated by cam slot 186 in a direction 90 degrees from its original position, as shown by the dotted lines of terminal portion 113, in order to avoid other mechanisms of machine 12.

Figure 10:
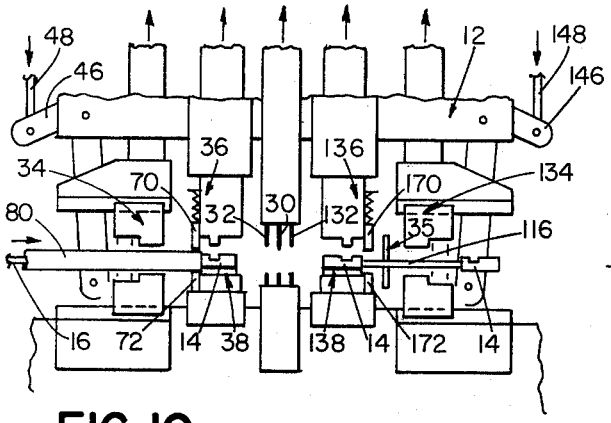
Figure 11:
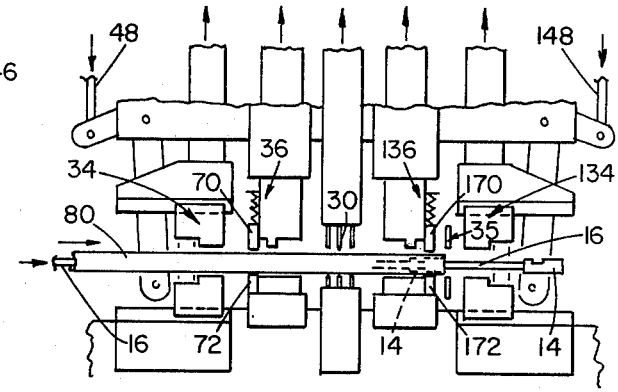

FIG. 19 illustrates the timing of the operation of the various mechanisms of machine 12. In operation, starting with the attachment of terminals 14 to stripped wire ends 17 and 117 of wire 16 and section of wire 116, respectively, at the completion of the prior cycle, all mechanisms are at their disengaged state, as best shown in FIG. 10. After the free section of wire 116 having terminals 14 attached to its ends is removed by ejector 35, wire guide tube 80 moves to the right, driven by guide tube motor and belt mechanism 92, and its forward end 79 receives the attached terminal 14 applied to end 17 of wire 16, as best shown by the dotted terminal 14 received within tube 80 in FIG. 11. With wire feed brake 98 in its open position, wire 16 is both pulled by wire guide tube 80 and driven by drive wheels 96 as wire 16 travels to the right. When it reaches its fully extended position, guide tube 80 stops adjacent terminal applicator 136. Wire 16 continues to be fed through inner guide tube 82 until wire 16 has reached its measured length.

Figure 12:
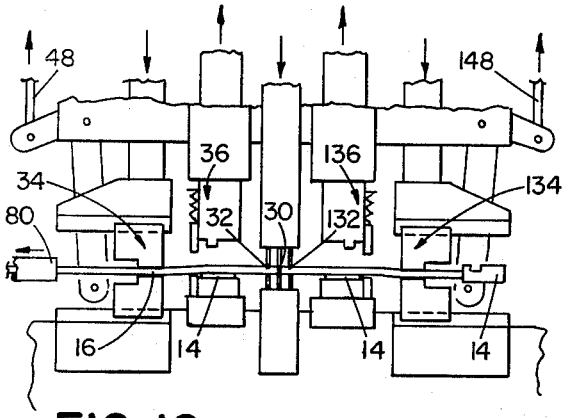

With drive wheels 96 disengaged and wire feed brake 98 actuated to hold wire 16, guide tube 80 retracts toward the left. Guide tube 80 deposits wire 16 in a overlapping position over the pair of terminals 14 positioned in terminal applicators 36 and 136, as shown in FIG. 12. Clamps 34 and 134 then close on wire 16, keeping wire 16 relatively taut in its overlapping position with terminals 14. Wire cutter 30 and wire end strippers 32, 132 are then closed to sever wire 16, creating a section of wire 116 which is clamped by clamp 134. Simultaneously, strippers 32, 132 cut through the insulation of wire 16 and section of wire 116, respectively, at two points on either side of the point of severance for stripping.

Figure 13:
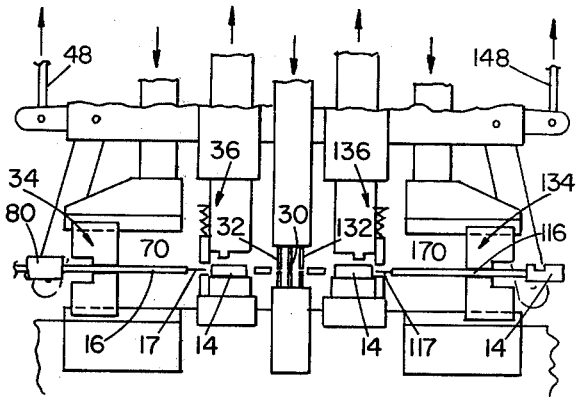

Clamps 34 and 134 then retract the severed portions of wire 16 and the section of wire 116, respectively, to provide the stripping action, as best shown in FIG. 13. As clamps 34, 134 move to their stripping or rearward positions, their pulling action strips the plastic insulation from the wire ends to produce two stripped wire ends 17 and 117. Terminal applicators 36 and 136 then move down, causing downwardly extending holddown members 70 and 170 mounted thereon, respectively, to contact stripped wire ends 17 and 117. Holddown members 70 and 170, downwardly biased by their respective springs 76 and 176, are capable of holding down stripped wire ends 17 and 117 firmly but still allow stripped wire ends 17 and 117 to be retracted by clamps 34 and 134. Downwardly extending screws 78 and 178 mounted on members 70 and 170, respectively, contact base members 72 and 172 in order to prevent stripped wire ends 17 and 117 being crushed by members 70 and 170.

As clamps 34 and 134 retract from their initial position, they pull stripped wire ends 17 and 117 from their initial overlapping position with terminals 14, as shown in FIG. 5*b*, to a non-overlapping position, as shown in FIG. 6*b*. As best shown by the sequence illustrated in FIGS. 5*a* through 8*a* and 5*b* through 8*b*, piston body 152 moves upward as its upper portion 151 connected to cam lever 155 is driven by cam 40. Piston rod 148, with its upper end catch block 147 latched to latch 162 of piston body 152, as best shown in FIG. 5*a*, is also moving upwardly to retract clamp 134. Clamp 134 is connected to link 150 which is connected to bell crank 146 which is in turn connected to lower end 149 of piston rod 148. When stripped wire end 117 has been retracted to the non-overlapping position with respect to terminal 14, as best shown in FIGS. 5*b*, 6*b*, 9 and 13, it then lies in the generally V-shaped notch 174 of base member 172. Notch 174 aligns stripped wire end 117 with open end 19 of wire-receiving portion 15 of terminal 14. The distance that stripped wire end 117 is longitudinally spaced from terminal 14 is determined by the height of release plate 156, which may be adjusted by release plate screw 158.

Figure 14:
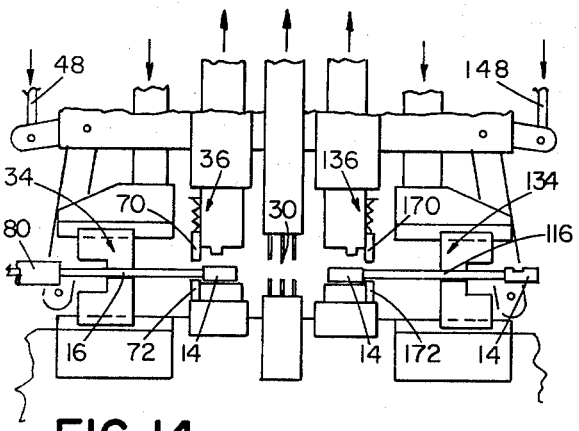

Piston rod trip member 160, connected to piston body 152, when engaged by release plate 156, triggers the release of piston rod latch 162 which normally latches the upper end catch block 147 of piston rod 148. This triggering action causes compression spring 154, which was compressed during the upward movement of piston rod 148, to force lower end 149 of piston rod 148 downwardly. The downward motion of piston rod 148 creates a quick forward motion of clamp 134, thereby causing it to insert stripped wire end 117 into wire-receiving portion 15 of terminal 14, as best shown in FIGS. 7*a*, 7*b* and 14. This quick inserting action of clamp 134 occurs at approximately the 178 to 180 degree point in the rotation of cam shaft 42, as best shown in FIG. 19.

Figure 15:
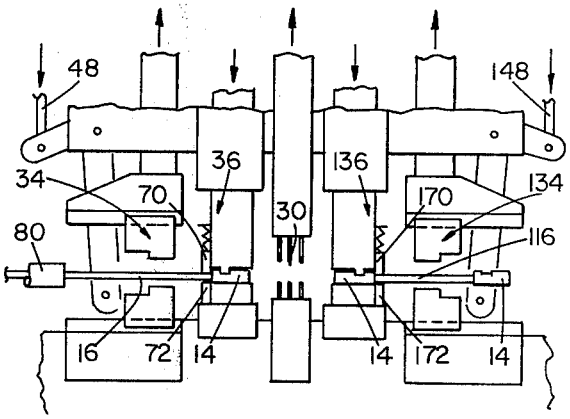

The depth of insertion of stripped wire end 117 in wire-receiving portion 15 of terminal 14 is controlled by stop insertion screw 166. Stop insertion block 164 is adapted to terminate the insertion motion of piston rod 148 when block 164 engages screw 166. Terminal applicators 36 and 136 then move transversely downwardly to crimp terminals 14 to stripped wire ends 17 and 117, respectively, as best shown in FIGS. 8*b* and 15. Reset screw 168 then engages lower end 149 of piston rod 148 to allow reset of the wire end position control mechanism, with upper end catch block 147 of piston rod 148 latching onto piston rod latch 162, as best shown in FIG. 8*a*. Guide tube 80 then moves to the right to repeat the cycle.

In the alternative embodiment of the guide tube of the present invention, wire guide tube 80 with its spring-biased inner tube may be adapted for use in the in-line open barrel terminal applying machine disclosed in U.S. Pat. No. 3,672,025. In another embodiment, as best shown in FIG. 18, a wire guide tube 180 having a spring-biased inner tube 182 and a helical tension relieving cam slot 186 at the forward end 179 of tube 180 may be adapted for use in the improved machine for attaching flag terminals disclosed in U.S. Pat. No. 3,965,559. Slot 186 is adapted to rotate the attached flag terminal 114 in a direction 90 degrees from its original attached position upon contact with the various mechanisms of machine 12 as guide tube 180 advances. As best illustrated in FIG. 18, when the terminal-receiving portion 113 of attached flag terminal 114 extending beyond the diameter of tube 180 contacts machine part 112 of machine 12, portion 113 is moved away from forward end 179 of tube 180 to relieve the tension of impact on portion 113 and cam slot 186 rotates terminal 114 in a direction 90 degree from its original position, as shown by the dotted lines of portion 113, to avoid other mechanisms of machine 12.

What is claimed is:

1. An automatic wire terminal applying machine for attaching a terminal to at least one end of a length of wire, said terminal having a metal body including a terminal-receiving portion and a wire-receiving portion of generally cylindrical shape, said machine having a plurality of longitudinally arranged operating means, including wire feed means for feeding said length of wire,
guide tube means for guiding said length of wire,
longitudinally movable wire clamping means,
wire stripping means for stripping said wire end,
terminal strip feed means for feeding a terminal,
transversely movable terminal applicator means, longitudinally spaced between said wire clamping and stripping means and operable to apply a terminal to a stripped wire end positioned in overlapping relationship with said terminal, and wire end position control means for longitudinally moving said wire clamping means to position said stripped wire end in overlapping relationship with said terminal for transverse application of said terminal thereto, said wire end position control means including wire retraction means for retracting said stripped wire end prior to operation of said terminal applicator means to a non-overlapping position longitudinally spaced from said terminal wire insertion means for advancing said stripped wire end prior to operation of said terminal applicator means from said non-overlapping position for longitudinal insertion thereof into said overlapping terminal position, said wire insertion means having depth of insertion means adapted to terminate the advance of said stripped wire end in said wire-receiving portion of said terminal said wire retraction means having trip means adapted to terminate the further retraction of said stripped wire end and to actuate said wire insertion means, and reset means adapted to reset said wire end position control means whereby said terminal applying machine is adapted to attach a closed barrel terminal to a length of wire, and said guide tube means includes an outer guide tube adapted to center and to guide said attached terminal through said machine said outer guide tube having a spring-biased inner guide tube concentric with said outer tube adjacent a forward end of said outer tube adapted to receive said wire whereby said outer tube is adapted to receive said attached terminal within said forward end of said outer tube when guiding said attached terminal through said machine.

2. The automatic terminal applying machine as claimed in claim 1, wherein said machine further includes wire end aligning and guiding means for longitudinally aligning said stripped wire end with a wire-receiving portion of a closed barrel terminal and for guiding said stripped wire end into said portion.

3. An automatic wire terminal applying machine for attaching a terminal to at least one end of a length of wire, said terminal having a metal body including a terminal-receiving portion and a wire-receiving portion, said machine having a plurality of longitudinally arranged operating means, including:

wire feed means for feeding said length of wire, guide tube means for guiding said length of wire, wire clamping means, wire stripping means for stripping said wire end, terminal strip feed means for feeding a terminal, and terminal applicator means, said guide tube means comprising an outer guide tube adapted to center and to guide said attached terminal through said machine and said outer guide tube having a spring-biased inner guide tube concentric with said outer tube adjacent a forward end of said outer tube adapted to receive said wire whereby said outer tube is adapted to receive said attached terminal within said forward end of said outer tube when guiding said attached terminal through said machine.

4. An automatic wire terminal applying machine for attaching a flag terminal to at least one end of a length of wire, said flag terminal having a metal body including a terminal-receiving portion and a wire-receiving portion including generally upright tabs, said machine having a plurality of longitudinally arranged operating means, including:

wire feed means for feeding said length of wire, guide tube means for guiding said length of wire, wire clamping means, wire stripping means for stripping said wire end, terminal strip feed means for feeding a terminal, and terminal applicator means, said guide tube means comprising an outer guide tube adapted to center and to guide said attached flag terminal through said machine said outer guide tube having a spring-biased inner guide tube concentric with said outer tube adjacent a forward end of said outer tube adapted to receive said wire and said forward end of said outer tube having a helical tension relieving cam slot thereon whereby said outer tube is adapted to rotate said attached terminal away from said forward end of said outer tube when guiding said attached terminal through said machine.

* * * * *